US007284357B2

(12) United States Patent
McInerney et al.

(10) Patent No.: US 7,284,357 B2
(45) Date of Patent: Oct. 23, 2007

(54) METHOD OF CREATING BARRIER TO FLUID FLOW UNDER CONCRETE SURFACE COAT OF CONCRETE FLOOR

(75) Inventors: Michael K. McInerney, Champaign, IL (US); Sean W. Morefield, Champaign, IL (US); Vincent F. Hock, Mahomet, IL (US); Philip G. Malone, Vicksburg, MS (US); Charles A. Weiss, Jr., Clinton, MS (US)

(73) Assignee: United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/368,473

(22) Filed: Mar. 7, 2006

(65) Prior Publication Data

US 2006/0150555 A1 Jul. 13, 2006

Related U.S. Application Data

(62) Division of application No. 10/715,430, filed on Nov. 19, 2003.

(51) Int. Cl.
*E04G 21/02* (2006.01)
*E04B 1/686* (2006.01)
*E04B 5/17* (2006.01)

(52) U.S. Cl. ..... 52/741.41; 52/413; 52/396.03

(58) Field of Classification Search ..... 52/409, 52/408, 411, 413, 746.11, 746.1, 741.4, 741.3, 52/741.41, 396.03
See application file for complete search history.

(56) References Cited

U.S. PATENT DOCUMENTS 1,986,999 A 1/1935 Burgess
2,036,123 A 3/1936 Dahlander
3,900,102 A 8/1975 Hurst
4,155,209 A 5/1979 Schirmer
4,932,183 A * 6/1990 Coulston ..... 52/417
5,002,620 A 3/1991 King
5,052,161 A 10/1991 Whitacre
5,137,764 A 8/1992 Doyle et al.
5,286,318 A 2/1994 Sims et al.
5,546,719 A 8/1996 Maiors et al.
6,286,279 B1 9/2001 Bean et al.
6,500,560 B1 12/2002 Kiik et al.
6,581,346 B2 6/2003 Melland
2002/0004538 A1 1/2002 Kalser et al.
2002/0160210 A1 10/2002 Kiik et al.
2003/0021979 A1 1/2003 Ramesh et al.

* cited by examiner

*Primary Examiner*—Carl D. Friedman
*Assistant Examiner*—Gay Ann Spahn
(74) *Attorney, Agent, or Firm*—Earl H. Baugher, Jr.

(57) ABSTRACT

A barrier to fluid passage is embedded within, instead of atop, porous material to retain the durability of the surface of the porous material. In one embodiment, a thin set mortar is applied to a concrete slab. A pleated metal foil is pressed into the wet mortar and a bond is established. The mortar is allowed to set and a top, or finish, section of concrete is then poured over the foil and finished conventionally. Provisions are made for sealing expansion joints in concrete slab floors and at the juncture of floor and wall. The foil may be provided in multiple layers to provide a mechanical bond via mortar oozing through perforations or along pleats in each of the top and bottoms layers, while providing a solid layer through which a fluid will not pass, at least in one direction.

7 Claims, 6 Drawing Sheets

METHOD OF CREATING BARRIER TO FLUID FLOW UNDER CONCRETE SURFACE COAT OF CONCRETE FLOOR

RELATED APPLICATIONS

This application is a division of U.S. patent application Ser. No. 10/715,430, Embedded Barrier to Fluid Flow, by McInerney et al., filed Nov. 19, 2003, and incorporated herein by reference.

STATEMENT OF GOVERNMENT INTEREST

Under paragraph 1(a) of Executive Order 10096, the conditions under which this invention was made entitle the Government of the United States, as represented by the Secretary of the Army, to the entire right, title and interest therein of any patent granted thereon by the United States. This patent and related ones are available for licensing. Contact Bea Shahin at 217 373-7234 or Phillip Stewart at 601 634-4113.

BACKGROUND

U.S. Pat. No. 6,286,279, Method for Attaching Fabric and Floor Covering Materials to Concrete, to Bean et al., Sep. 11, 2001, and incorporated herein by reference, teaches bonding a thin metal plate or metal foil to a concrete surface to effect a barrier to water vapor transfer. The configuration of the '279 patent improves the maintenance of the bond between a concrete surface and various types of floor coverings. The '279 patent teaches two systems for implementing the barrier: one uses a single-layered thin metal plate or metal foil that is folded to produce recesses much like corrugated sheet metal. One side of the foil is attached to the concrete surface using a Portland cement-based thin set grout. A second embodiment employs a two-part thin metal plate or foil. A first lower part is perforated (or slit and expanded) and attached to a second solid upper part. The lower perforated part is embedded in a layer of thin set mortar on the concrete to anchor it to the concrete. The thin set mortar that oozes through the perforations also serves as a mechanical bond, a "cementitious rivet," supplementing the chemical bond made along the contact surface.

A preferred embodiment of the present invention is an improvement on the '279 patent in that it allows the thin metal plate or metal foil to be embedded just below the surface of the underlayment, concrete in the case of a "poured slab," so that there is a layer, e.g., concrete, both above and below the thin metal plate or metal foil. That is, a robust "finish" surface, e.g., concrete, is placed above the thin metal plate or metal foil, thus presenting a durable surface of conventional appearance. One advantage of this design is the ability of the surface to resist moisture flow from without while accommodating typical use, e.g., that of hard-wheeled vehicles that would otherwise damage vinyl or carpet floor coverings.

SUMMARY

A fluid, or vapor, barrier is encapsulated within a durable structure to preclude passage of fluid in at least one direction while retaining the durability of a surface of a structure that conventionally does not contain such a barrier.

A first preferred embodiment of the present invention employs a two-part folded thin metal (or composite) plate or metal (or composite) solid (un-perforated) foil such as provided in the '279 patent, but embedded just below the top surface of a durable surface such as an underlayment, typically a concrete "slab" or floor.

Alternatively, a second preferred embodiment of the present invention employs a two-part thin metal plate or metal foil differing from that of the '279 patent in that the second or top layer of metal is a perforated thin plate or metal foil. The perforations on the top side of the second (top) layer serve to facilitate the formation of a mechanical bond via the concrete oozing through the perforations and acting as a "cementitious rivet" between the top side of the second layer and the bottom side of the surface of the underlayment above this second (top) layer. This mechanical bond acts in addition to any chemical bond formed between the bottom side of the underlayment surface and the remainder of the upper surface of this second (top) perforated layer. This second preferred embodiment must employ a solid thin metal plate or metal foil as a first (bottom) layer to block passage of moisture through the path provided by the underlayment material, typically concrete, that, upon installation, oozed through the perforations in the second (top) layer of perforated thin metal plate or metal foil. That is, if a perforated second (top) layer of a two-part thin metal plate or metal foil is used to achieve a better bond, then the first (bottom) layer must be solid, and conversely, if a perforated first (bottom) layer is used, then the second (top) layer must be solid.

Alternatively, a third preferred embodiment of the present invention employs a three-part thin metal plate or metal foil differing from that of the '279 patent in that a solid center foil or thin metal plate has an expanded metal foil or thin metal plate, e.g., pleated foil, applied to both sides. Application of the top and bottom pleated foils or thin pleated metal plates may be by way of spot welding in one embodiment. This results in a three-layered system that provides opportunity for the adhesive, e.g., thin-set mortar, to infiltrate slots in the lower foil (or thin metal plate) positioned over the adhesive immediately applied to an existing slab, while the expanded foil (or thin metal plate) attached to the top of this three-layer version establishes a similar mechanical and chemical bond to the overlaid concrete that forms a surface, e.g., concrete flooring. This particular embodiment also aids in resisting "curling" of an overlaid concrete layer that provides a durable surface for use by hard-wheeled vehicles.

A preferred method of applying a first preferred embodiment of the present invention to an existing porous surface, such as cured concrete, comprises:

- applying a layer of adhesive, such as thin set mortar, to the existing surface;
- placing a folded or pleated thin metal plate or folded or pleated metal foil on the layer of adhesive, e.g., thin set mortar;
- embedding the bottom of the thin metal plate or metal foil into the adhesive, e.g., thin set mortar;
- covering the top of the folded or pleated thin metal plate or folded or pleated metal foil with a thin layer of durable material, such as concrete;
- permitting the adhesive to cure; and
- finishing and curing the thin layer of durable material, e.g., concrete, as needed.

Note that if concrete is used as a finish layer, consolidation of this covering concrete must be done with care to avoid loosening the foil bonded to the adhesive, e.g., thin set mortar.

As an alternative, seams between the pieces (sheets) of the folded or pleated thin metal plate or folded or pleated metal foil may be sealed with flexible commercially available room temperature vulcanizing (RTV) products appropriate for use in alkaline environments. As a further alternative, employing accordion-style pleats at edges of the thin metal plate or metal foil accommodates panel movement while avoiding tearing or breaking the folded thin metal plate or folded metal foil should the installed surface move under load. Of course, this method is not limited to existing installations but may be employed upon initial installation of an underlayment or wall.

In installing a second preferred embodiment, the above method of installation may be applied using a two-part thin metal plate or metal foil having a first (bottom) layer and a second (top) layer, instead of a single folded thin metal plate or folded metal foil.

In another method of installing the second preferred embodiment a two-part thin metal plate or two-part metal foil is used in which the second (top) layer incorporates perforations and the first (bottom) layer is solid.

In yet another method of installing the second preferred embodiment, the immediately above method of installation may be applied using a two-part thin metal plate or two-part metal foil in which the first (bottom) layer incorporates perforations and the second (top) layer is solid.

Finally, the above method of installation may be applied using the third preferred embodiment, a three-layer sandwich comprising top and bottom layers of perforated, folded or pleated foil or thin metal covering a solid middle layer of foil or thin metal. The top and bottom layers may be joined to the solid center layer by any of a number of suitable processes, e.g., tack welding.

Embodiments of the present invention are not limited to underlayments but may be used on vertical or slanted surfaces where protection from fluid intrusion is desired. Further, a "one-way" vapor barrier may be installed to prevent intrusion of fluids while permitting expulsion of the same fluids or vapors. Instead of a metal foil or thin metal plate, a special "breathing" material such as those marketed under the trademark GORETEX® (liquid impermeable, moisture vapor transmissive material) may be used in place of metal. This would have particular application in below grade applications such as basement floors or walls and in environments of high humidity such as kitchens or bathroom floors or walls that otherwise "sweat." In addition to embedding the GORETEX® (liquid impermeable, moisture vapor transmissive material) lining in concrete on a slab, it could be embedded just beneath a porous outer stucco or similar coating to achieve the same effect as the metal barrier does in the underlayment while also permitting "out gassing" of vapors from within the room.

Embodiments of the present invention may be used in any application where it is necessary to prevent the movement of fluids (liquid or gas) through porous material, such as concrete. Specifically, embodiments may be used to block the movement of water vapor and will be equally effective in preventing the movement of stable gases, such as radon, through porous material, such as concrete.

The "embedded barrier" of the present invention, in all of its preferred embodiments, is unique in its implementation. For example, conventionally, a concrete slab has been "sealed" by pre-placing a polymer membrane under the slab prior to placing the new concrete. Once the concrete slab had been installed, the slab could be further sealed only at its top surface. This sealing of the top surface has been accomplished conventionally by using epoxy, fiberglass or combinations of fiberglass and epoxy, leaving a surface that was less durable than a concrete surface.

To summarize some of the salient advantages of preferred embodiments of the present invention:

- it permits modifying existing installations, e.g., addition of concrete above the metal barrier on existing slabs;
- it allows a trafficked surface above a vapor barrier to be made of durable castable material such as concrete or asphalt concrete;
- it provides a continuous sheet of metal foil that also serves to reinforce an underlayment, such as a concrete slab;
- it reduces the opportunity for cracking that occurs on one side of a structure to propagate to the other side;
- it reduces the opportunity for fractures that exist in the lower part of an underlayment, e.g., a concrete slab, to widen or propagate laterally;
- in a preferred embodiment it prevents curling of a top surface of concrete that has been applied to an existing concrete slab; and
- in an alternative embodiment, it accommodates joints between panels of structure, such as an underlayment, by employing a pleated barrier joining section thus permitting movement without compromising the integrity of the barrier.

Further advantages of the present invention will be apparent from the description below with reference to the accompanying drawings, in which like numbers indicate like elements.

DETAILED DESCRIPTION

Figure 1:
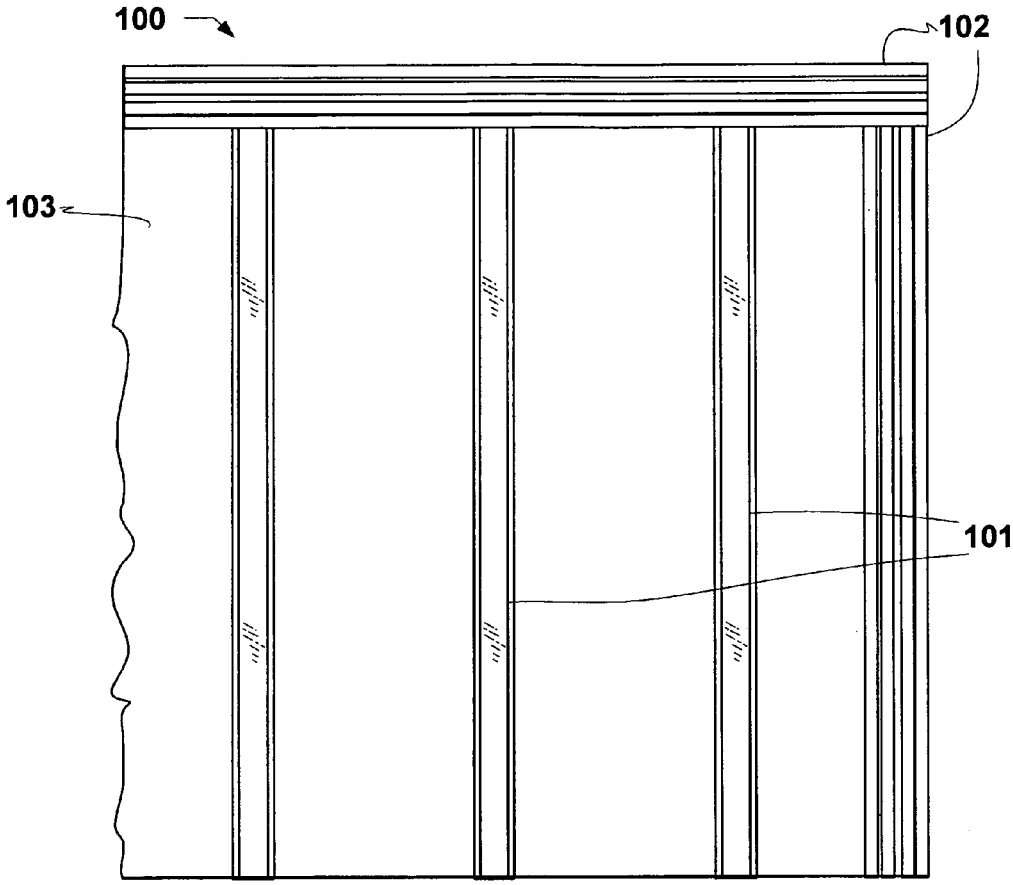
FIG. 1 is a top view of a single piece thin metal plate or metal foil that may be used in a preferred embodiment of the present invention.

Refer to FIGS. 1, 3A, 3B, and 6A. Provided is a method of implementing a fluid barrier within porous material such as concrete. In a preferred embodiment, a barrier panel 100, in one embodiment including pleats 101 and having pleated edges 102, is placed between a "base" 311 of porous material, such as a concrete slab, and an emplaced topmost section 313 of durable material, such as concrete, thus creating a topmost surface suitable for use by wheeled traffic. A single layer 600 plate or foil with pleats 101 and related spacings 601 between the pleats 101 may be used as an embedded fluid barrier such as shown at 310. Also shown at 310 are depictions 315 of the adhesive 312 as it forms in the valleys between pleats 101 and the formation of anchoring portions 314 of the initially "flowable" top layer 313 as it is placed on the surface 103 of a pleated single layer panel 100 of the configuration at 310.

Figure 3A:
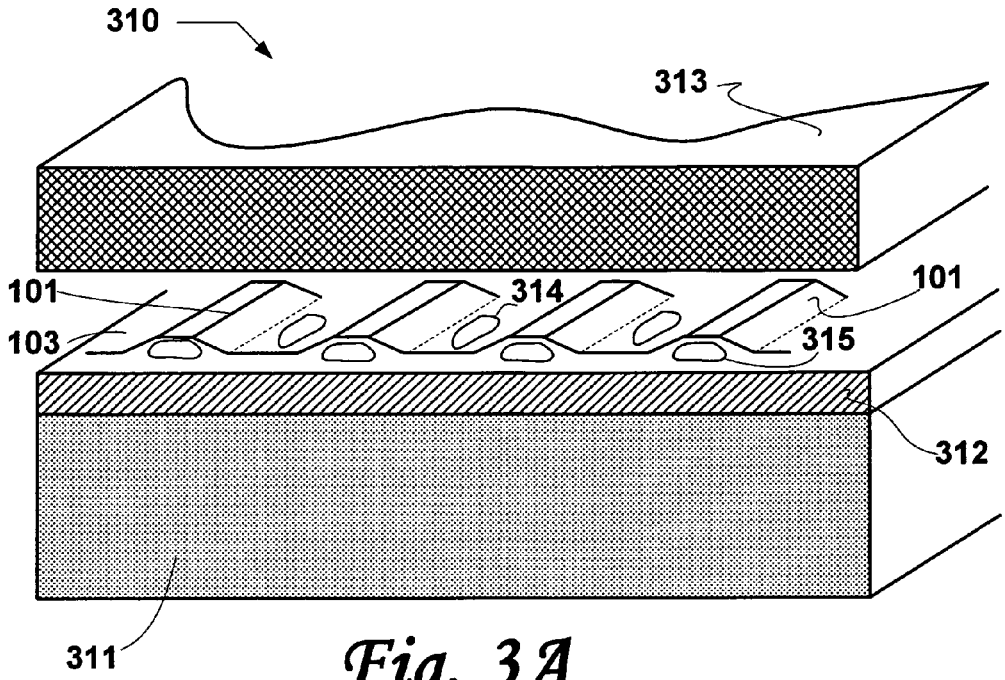
FIG. 3A is a perspective view of the single piece thin metal plate or metal foil of FIG. 1 as installed in a typical installation.
Figure 3B:
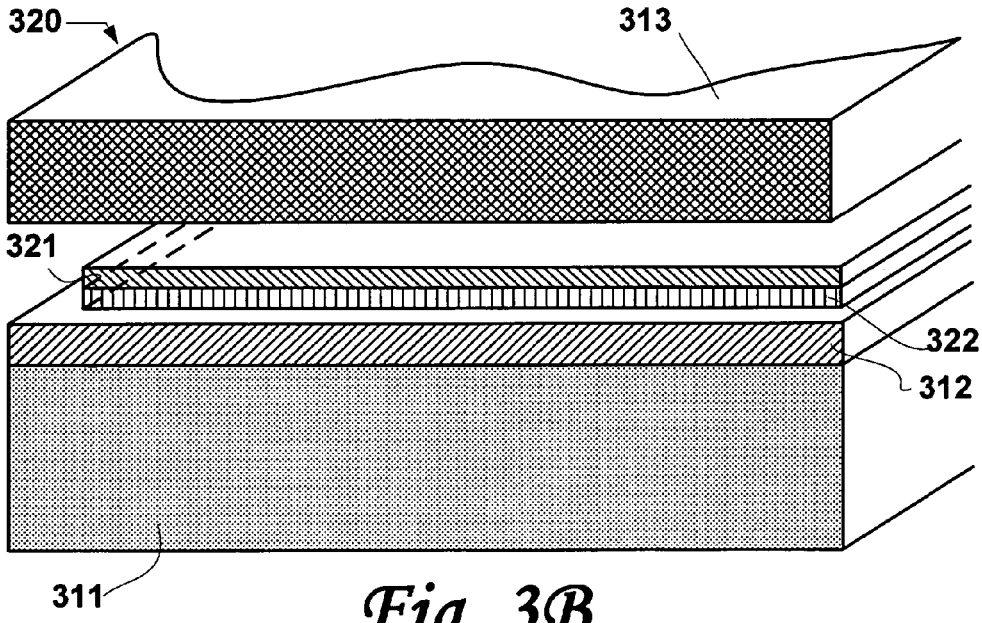
FIG. 3B is a perspective view of the two-piece thin metal plate or metal foil of FIGS. 2A and 2B as installed in a typical installation.
Figure 7:
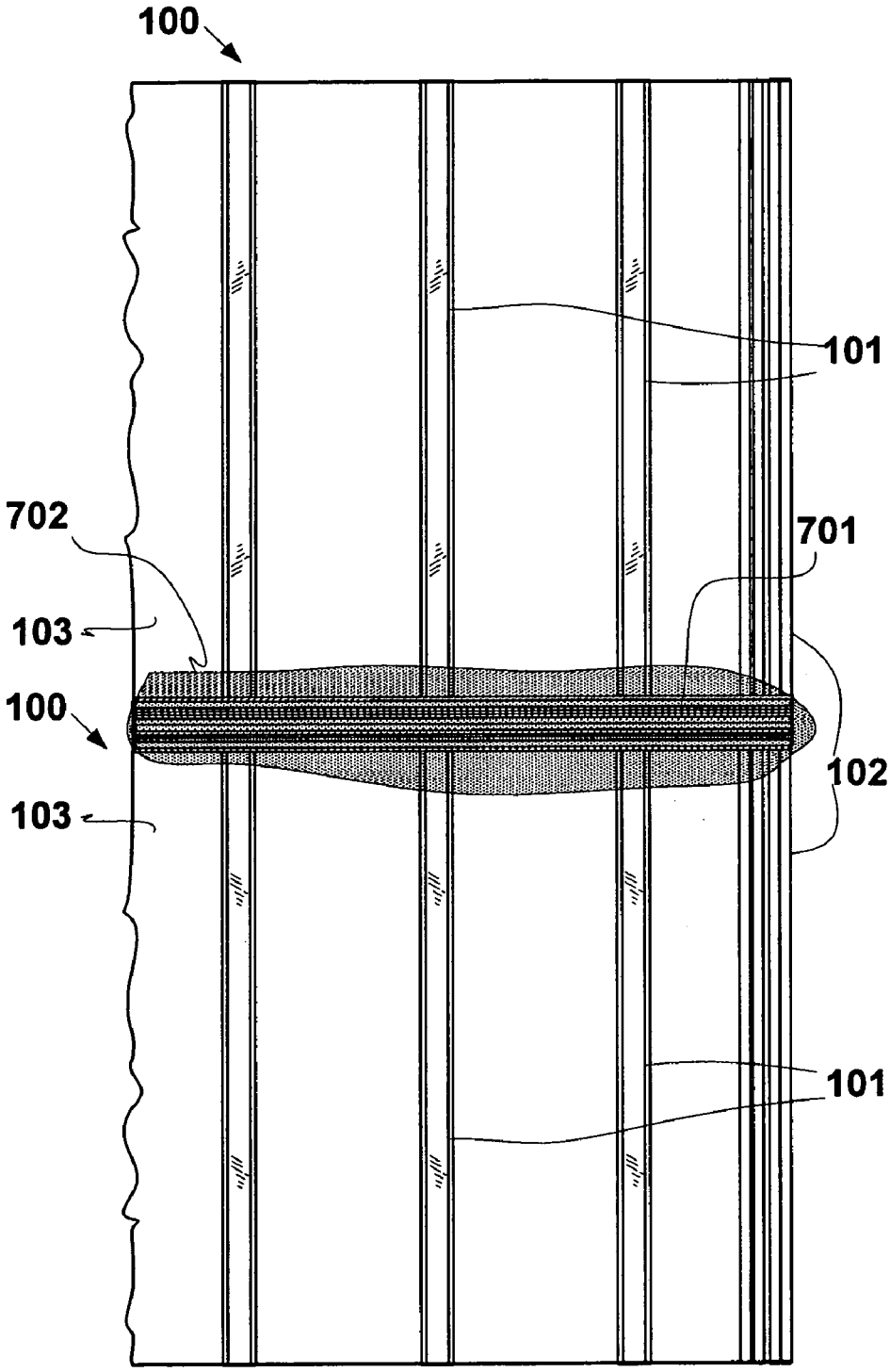
FIG. 7 depicts an alternative means of joining two sections of barrier that may be used in a preferred embodiment of the present invention.

Refer to FIGS. 3A, 3B and 7. Also provided in a preferred embodiment of the present invention is a configuration 310 such as shown in FIG. 3A or the configuration 320 shown in FIG. 3B implementing a barrier to fluid flow in at least one direction and enclosed within porous material. Either configuration 310, 320 uses a durable top section 313 applied over the barrier panel 100 placed upon adhesive 312 coated on a first section 311 of the porous material. Either configuration 310, 320 is thus made suitable for routine use by wheeled traffic. Both configurations comprise:

at least one layer of adhesive 312 applied to a top surface of the porous material comprising a base 311, e.g., thin set mortar applied to a concrete slab;

panels 100 of non-porous material having edges 102 suitable for overlapping, e.g., pleated edges, as shown at 701 of FIG. 7, affixed to a topmost layer of adhesive 312 so as to completely cover the adhesive 312, a flexible sealant as shown at 702 of FIG. 7 applied between the overlapping edges as shown at 701 of FIG. 7; and the topmost section 313 emplaced upon the panels 100 so as to completely cover all said panels 100, the topmost section 313 incorporating the top surface suitable for routine use by wheeled traffic.

In a preferred embodiment of the configuration, the barrier is a vapor barrier embedded, i.e., completely enclosed, in porous material. The non-porous material used for the panels 100 may be selected from: a metal, a metal alloy, a steel alloy, a stainless steel, a composite material, a composite material containing at least some metal, and combinations thereof.

In a preferred embodiment of the configuration, the non-porous material comprises at least one metal and the porous material comprises at least some concrete. Further, the adhesive 312 may be a thin set mortar applied to a thickness of about 6 mm (¼ inch). In a preferred embodiment of the configuration in which the porous material at least partially comprises concrete, the topmost section may comprise concrete applied to a thickness of about 2.5 cm (1 inch) or more.

Refer to FIG. 7. In a preferred embodiment of the configuration, a seal 702 comprises a continuous bead of a flexible sealant applied along the entire length between all overlapped edges 701 of the panels 160. A preferred embodiment of flexible sealant is a RTV sealant.

Figure 2A:
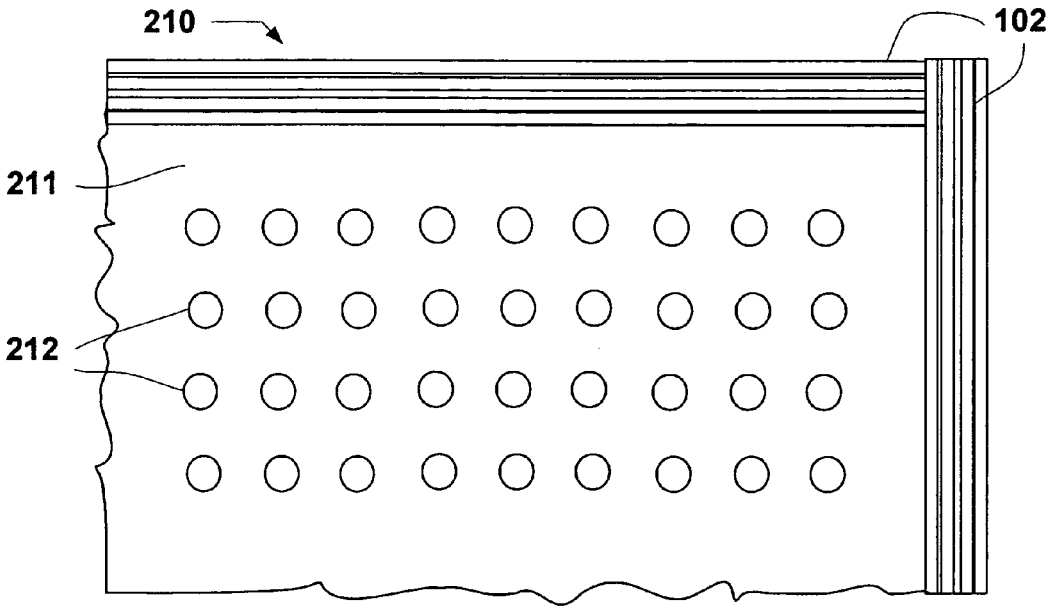
FIG. 2A is a top view of the perforated piece of a two-piece thin metal plate or metal foil used in a preferred embodiment of the present invention.
Figure 2B:
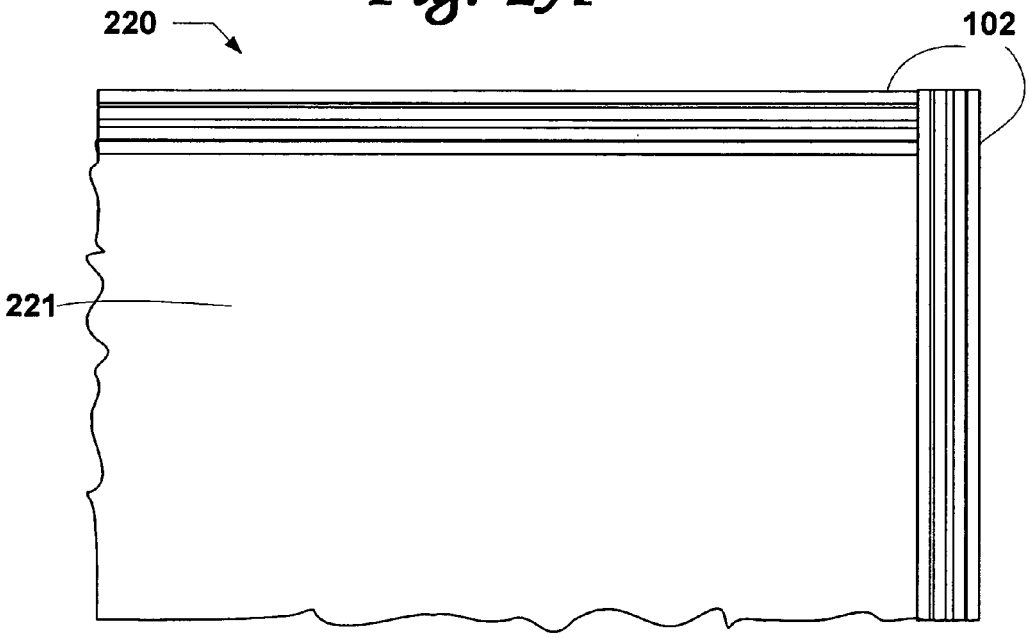
FIG. 2B is a top view of the solid piece of a two-piece thin metal plate or metal foil used in a preferred embodiment of the present invention.

Refer to FIGS. 2A, 2B, and 3B. In a preferred embodiment of the configuration, the panels 100 are plates of a total thickness less than about 6 mm (¼ inch). In an alternate preferred embodiment, the panel 100 comprises a first perforated plate 210 in contact with a second solid plate 220, i.e., a two-layer panel 100, each of the first 210 and second 220 plates being of a total thickness of less than about 3 mm (⅛ inch). A preferred configuration places a first perforated plate 210 "layer" immediately adjacent the bottom side of the topmost section 313, e.g., the finish layer of concrete. A generic two-layer configuration 321, 322 representing this preferred configuration is shown in FIG. 3B. The first perforated plate 210 would be placed at 321 in FIG. 3B and the second solid plate 220 at 322 in FIG. 3B.

Refer to FIGS. 2A, 2B, and 3B. In an alternate preferred embodiment of the configuration, the panels 100 comprise a multi-layer foil of a thickness less than about 2 mm (0.08 inch) and preferably in the range of about 0.5-1.5 mm (20-60 mils), and may be represented as in FIG. 3B as a perforated foil (such as depicted in FIG. 2A at 210) at 321 and a solid foil (such as depicted in FIG. 2B at 220) at 322. Each of the foil layers 210, 220 in a two-layer foil 321, 322 used in a preferred embodiment of the present invention has a total thickness of less than about 1 mm (0.04 inch) and preferably in the range of about 0.25-0.76 mm (10-30 mils).

Figure 6A:
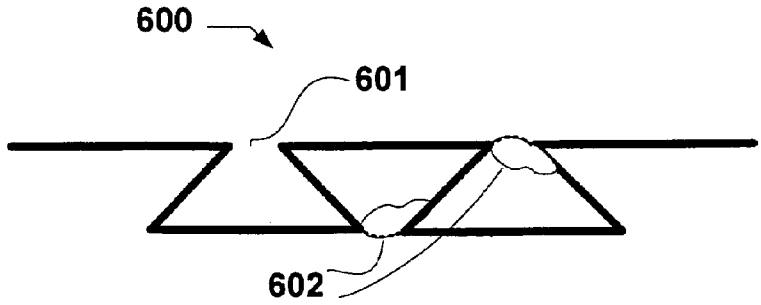
FIG. 6A depicts a single layer thin metal plate or foil that has been pleated to be used with a preferred embodiment of the present invention.
Figure 6B:
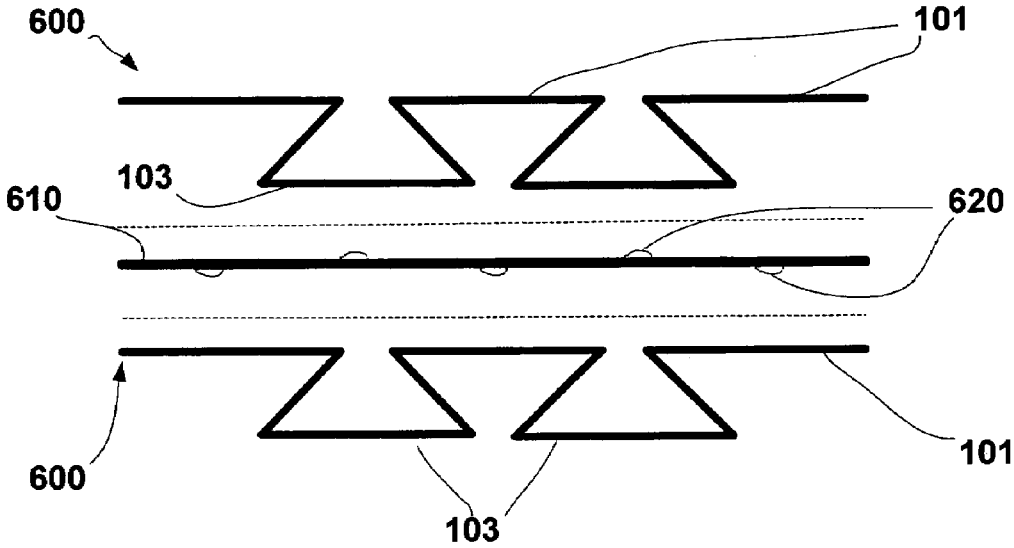
FIG. 6B depicts a three-layer barrier, two of which layers are that configuration shown in FIG. 6A as may be used with a preferred embodiment of the present invention.

Refer to FIGS. 1, 3A, 6A and 6B. In yet another preferred embodiment, the configuration employs panels 100 comprising three-layers, two identical configurations as shown at 600, and a single flat configuration as shown at 610. In FIG. 6A, the adhesive 602 is shown as it oozes into the folds of the foil or thin metal from the layers of porous material (not shown separately in FIG. 6A) above and below the foil or thin metal configuration 600. In FIG. 6B, by contrast, the adhesive 620 is emplaced to adhere to the portion of the thin foil or thin metal configuration 600 in direct contact with a separate middle layer 610 as described immediately below. These configurations 600, 610 may be metal (or composite) foil or thin metal (or composite) sheets or plates. The top 600 and bottom 600 layers of the three-layer panel 600, 610 may be perforated, a solid that is folded or pleated, and combinations thereof, while the middle layer 610 must be solid if both the top and bottom layers 600 are perforated. As foils, the layers 600, 610 each may be of a thickness less than 1.0 mm (40 mils) and more preferably less than about 0.76 mm (30 mils) and most preferably in a range of thickness from about 0.25-0.76 mm (10-30 mils).

A preferred method of implementing an embedded barrier comprises:

applying at least one layer 312 of adhesive, such as a thin set mortar, to an entire first surface of the porous material of the base 311, e.g., a concrete slab, prior to emplacing the topmost section 313, e.g., a finish layer of concrete;

placing panels 100 of non-porous material, such as a metal or composite plate or metal or composite foil, upon a topmost layer 312 of adhesive (if more than one layer of adhesive is used), overlapping edges 102 of each panel 100 with edges of any panels 100 placed adjacent thereto in the same plane along the topmost layer 312 of adhesive such as shown at 701 in FIG. 7, and completely covering the topmost adhesive layer 312 with the overlapping panels 100;

establishing a seal 702 as shown in FIG. 7 between all the overlapped panel edges 701; and emplacing at least one layer of material comprising a topmost section 313 upon the panels 100 such that each panel 100 is confined below the topmost section 313 and above a topmost layer 312 of adhesive.

Employing this method, i.e., providing one or more adhesive layers 312 upon a surface of a base 311 of porous material, placing "barrier" panels 100 of one or more layers such as layers depicted at 210, 220, 600, 610 upon the topmost layer 312 of adhesive, establishing a seal 702 between the overlapped edges 701 of the panels 100 and emplacing a topmost section 313 to encapsulate the panels 100, implements a fluid barrier within porous material, preferably durable porous material such as concrete.

Refer to FIG. 3A. In one preferred method, the adhesive 312 may then be allowed to "set" or cure prior to installing a finish layer 313 over the plate (or foil) 100. Not all methods may require curing of the adhesive 312 prior to the finish step, however. The finish layer 313 may be a poured fluid, such as concrete, such that the concrete oozes into the spaces between the channels 101 as shown at 314, thus facilitating a strong bond between the plate (or foil) 100 and the finish layer 313. For those underlayments 311 that are exposed to heavy traffic, including hard-wheeled vehicles, for example, the finish layer 313 may be relatively thick concrete. In one preferred embodiment, the result is a multi-layered configuration 310 that achieves an effective moisture and vapor barrier to fluid ingress from beneath the underlayment 311, while permitting heavy traffic on its concrete finished surface 313.

The method of emplacing a fluid barrier within porous material extends to establishing a vapor barrier in porous material. The vapor barrier may be a one-way barrier such that the configuration is permitted to "breathe" or "outgas" in one direction while establishing and maintaining a fluid barrier in the opposite direction.

In a preferred embodiment of a method of implementation of the present invention, the method employs non-porous material comprising at least one metal and the porous material comprises at least some concrete. Further, the topmost adhesive layer 312 may be a thin set mortar applied to a thickness of about 6 mm (0.25 inch). In a preferred embodiment in which the porous material at least partially comprises concrete, the topmost section may comprise concrete applied to a thickness of about 2.5 cm (1.0 inch) or more.

Refer to FIGS. 3A, 3B, and 7. In a preferred embodiment of a method of implementing the present invention, a seal 702 may be established, at least in part, by applying a continuous bead of a flexible sealant along the entire length between all overlapped edges 701 of the panels 100. A preferred embodiment of flexible sealant is a RTV sealant. In applications where concrete is to be applied as a finishing layer 313, the RTV sealant should be suitable for use in alkaline environments.

Refer to FIGS. 1, 2A, 2B and 3B. In a preferred method of implementing the present invention, the panels 100 comprise multiple layers 321, 322 of plates of a total thickness less than about 6 mm (0.25 inch). In an alternate preferred method, the panels 100 comprise a perforated plate 210 as a first layer 321, the perforated plate 210 having evenly spaced perforations 212 on its interior surface 211 and abutted about its entire surface area to a second solid plate 220 as a second layer 322, the solid plate having a solid interior surface 221, and each of the first 210 and second 220 plates being of a total thickness of less than about 3 mm (0.125 inch). A preferred method is to place the first perforated plate 220 immediately adjacent the bottom side of the topmost section 313 as shown at 321 in the configuration 320 of FIG. 3B.

Refer to FIGS. 2A, 2B, and 3B. In an alternate preferred method, the method employs panels 100 comprising multi-layer foil of a thickness less than about 4 mm (0.16 inch), and more preferably less than about 2.5 mm (100 mils), and most preferably about 0.5 mm to 1.5 mm (20-60 mils). In yet another alternate preferred method, the panels 100 comprise a first perforated foil 210 as a first layer 321 of a two-layer foil 321, 322, the second layer 322 being a solid foil 220. Each of the first and second foil layers 321, 322 has a total thickness of less than about 2 mm (80 mils), and more preferably less than about 0.76 mm (30 mils), and most preferably about 0.25 mm to 0.76 mm (10-30 mils). In a preferred embodiment, the first perforated foil 210 is placed immediately adjacent the bottom side of the topmost section 313 as shown at 321.

Refer to FIGS. 1, 3A, 6A and 6B. In yet another preferred embodiment, the method employs panels 100 comprising three-layers, two identical configurations as shown at 600, and a single flat configuration as shown at 610. These may be metal (or composite) foil or thin metal (or composite) sheets or plates. The three layers 600, 610 are bonded together by any of a number of suitable means, such as by gluing, heating, applying pressure, soldering, tack welding, or combinations of the above. The top 600 and bottom 600 layers of the three-layer panel 600, 610 may be perforated, a solid that is folded or pleated, and combinations thereof, while the middle layer 610 must be solid if both the top and bottom layers 600 are perforated. As foils, the layers 600, 610 each may be provided in a thickness less than 1.0 mm (40 mils) and more preferably less than about 0.76 mm (30 mils) and most preferably in a range in thickness from about 0.25-0.76 mm (10-30 mils).

Figure 4:
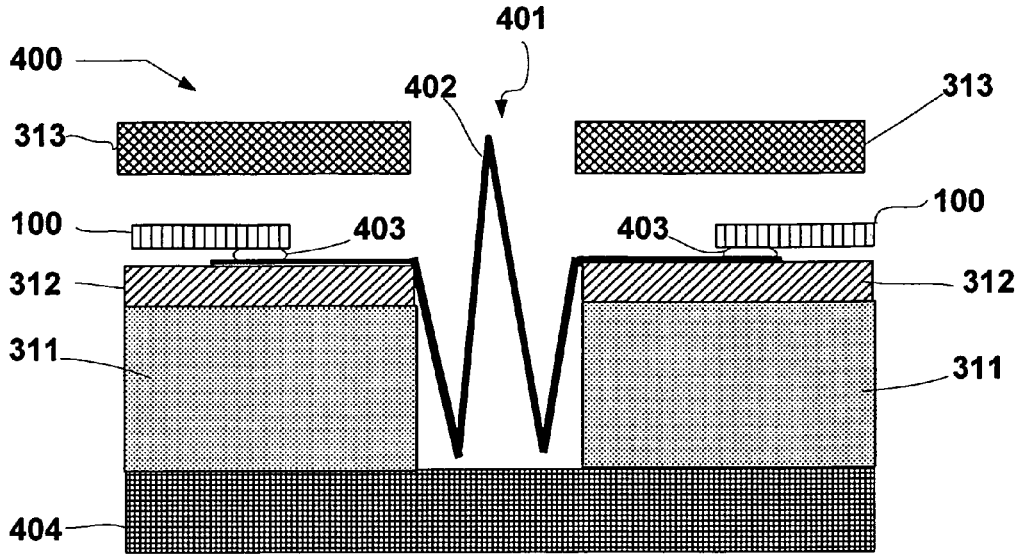
FIG. 4 depicts an alternative installation of a preferred embodiment of the present invention in which an expansion joint is used between flooring panels.

Refer to FIG. 4. Some installations 400 of underlayments 311, such as a concrete slab, applied over a prepared base 404, such as an aggregate, incorporate embedded expansion joints. A preferred embodiment of the present invention incorporates a sealed expansion joint 401 between each of the overlaid top sections 313 and a corresponding portion of the underlayment 311. This sealed expansion joint 401 comprises a pleated non-porous strip 402 that is placed over the adhesive 312 at the expansion joint 401 to overlap the entire length of each side of the expansion joint 401 below the installed panels 100 (that may be thin metal or composite plates or foil layers), each overlap of a width less than about 5.0 cm (2.0 inches). The strip 402 is then sealed with an appropriate sealant as shown at 403 along each longitudinal edge of the strip 402 between the top surface of the edge of the strip 402 and the bottom of each panel 100 abutting the expansion joint 401. A preferred embodiment employs a continuous bead 403 of flexible sealant, such as an RTV, applied along the entire length of the expansion joint 401.

Refer to FIGS. 2A, 2B and 3B. FIG. 2A depicts the perforated piece 210 of a two-piece thin metal plate (or foil) structure shown installed in FIG. 3B at 321, 322. The perforations 212 in the main part 211 of this perforated piece 210 facilitate bonding of the metal plate (or foil) structure to either the adhesive layer 312 or the overlaying finish layer 313 as shown in the resultant multi-layered structure 320 of FIG. 3B. The solid piece 220 of the two-piece thin metal plate (or foil) is shown installed as one of the layers in FIG. 3B at 321, 322. The configuration 320 of FIG. 3B facilitates additional mechanical bonding of the two-piece plate 321, 322, to either the adhesive layer 312 or the finish layer 313, but not both while providing a solid interface to prevent moisture or vapor flow from beneath the underlayment 311. A preferred method of installation is to mount the perforated piece 210 against the finish layer 313 and the solid piece 220 against the adhesive layer 312. In the case of a concrete finish layer 313, this provides protection for the mechanical bond developed by the concrete as it oozes into the perforations 212 in the perforated piece 210 since no moisture or vapor passes through the solid piece 220 mounted next to the adhesive layer 312, for example, thin set mortar in the case of a concrete underlayment 311. Although the perforations 212 are shown as circular holes in FIG. 2A, other means of perforation may be used. For example, the perforated piece 210 may comprise metal screen material very similar to that used in screening windows to prevent insect ingress, a wire mesh, or combinations of types of perforations. Also shown in FIGS. 2A and 2B are alternative edges 102 that facilitate flexion of the installed two-piece plate (or foil) 210, 220 in much the same manner as described above for the one-piece configuration 100 of FIG. 1. The two pieces 210, 220 may be joined together prior to installation by any of a number of means such as application of adhesive to parts of their adjoining surfaces, mechanically pressing edges together, soldering, welding, and combinations of these means. Further, the two pieces 210, 220 may be installed separately and either joined as would be done in methods described above for joining prior to installation or simply placed one above the other as part of the installation with the weight of the finish layer 313 and the adhesion of the adhesive layer 312 serving to maintain proper alignment. Adjacent two-piece plates (or foils) 210, 220 may be connected in the same manner as for the one-piece plates (or foils) 100 as described above.

Refer to FIG. 4. Expansion joints 401 provide for movement of underlayment 311 in many cases. A preferred embodiment 400 of the present invention provides for bridging these joints 401 while sealing the joint 401 from moisture or vapor and avoiding tearing the underlying metal plate (or foil) 100, 210, 220, 321, 322. In a preferred embodiment of the present invention, a separate flexible and expandable "bridge" 402 is provided for bridging expansion joints in underlayments 311 above a sub-grade 404. This bridge 402 may be a long narrow section of thin metal plate (or foil) similar to that used as the moisture and vapor barrier. The longitudinal edges are flat while the center section is accordion-shaped or pleated to permit movement. These bridges 402 are installed over, and bond to, the adhesive layer 312 at the expansion joint 401 prior to installation of the thin metal plate (or foil) 100, 210, 220, 321, 322. The bridges 402 are then bonded to the thin metal plate (or foil) 100, 210, 220, 321, 322 via any of a number of suitable means such as the application of a continuous bead 403 of a flexible sealant, e.g., any of various commercial RTV sealants suited to the application.

Figure 5:
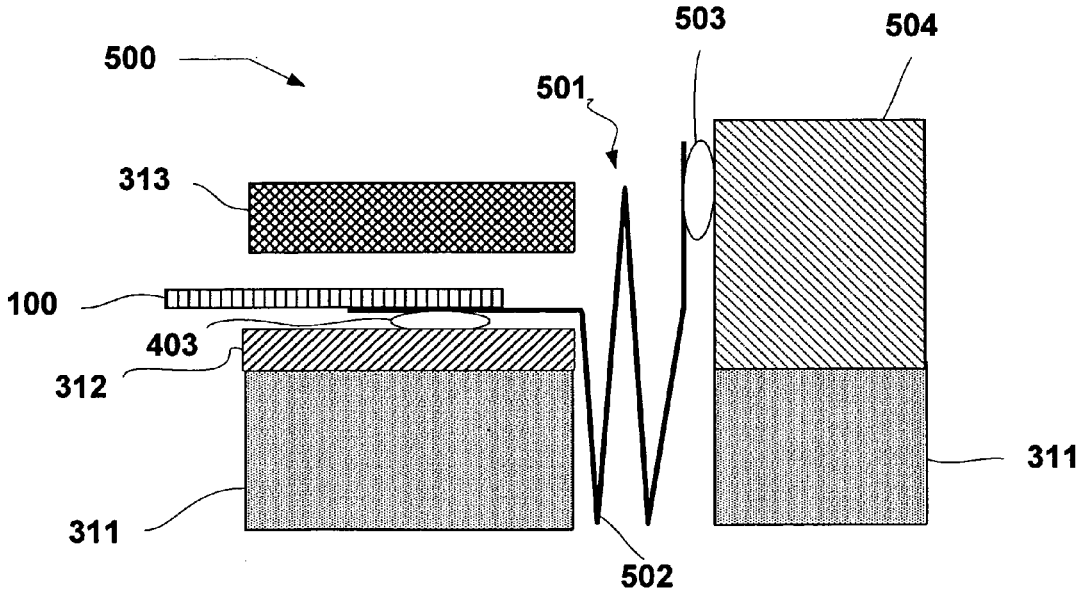
FIG. 5 depicts an alternative installation of a preferred embodiment of the present invention in which an expansion joint is used between a flooring panel and an adjoining vertical wall.

Refer to FIG. 5. In much the same way as expansion joints 401 are provided for in underlayments 311, the joint 501 between a floor and a wall 504 is also subject to movement and a preferred embodiment 500 of the present invention provides for addressing this joint 501 also. The bridge 502 used in this application is affixed at one end to the underlayment in the same manner as for the in-floor expansion joint 401. The bridge 502 is bent at a right angle to permit installation along the adjoining wall 504 to a point just above the top of the finish layer 313. A bead 503 of suitable flexible sealant, such as any of a number of commercial RTV sealants, is applied along the entire length of the bridge 502 at the wall 504.

The abstract of the disclosure is provided to comply with the rules requiring an abstract that will allow a searcher to quickly ascertain the subject matter of the technical disclosure of any patent issued from this disclosure. 37 CFR § 1.72(b). Any advantages and benefits described may not apply to all embodiments of the invention.

While the invention has been described in terms of its preferred embodiments, those skilled in the art will recognize that the invention can be practiced with modifications within the spirit and scope of the appended claims. For example, although the system is described in specific examples related to concrete structure, it may be adapted to other porous construction materials, such as drywall, chipboard, wood, tile, composites, and combinations thereof. Thus, it is intended that all matter contained in the foregoing description or shown in the accompanying drawings shall be interpreted as illustrative rather than limiting, and the invention should be defined only in accordance with the following claims and their equivalents.

We claim:

1. A method of creating a barrier to fluid flow in discrete structures in at least one direction, one said barrier embedded within porous material in each discrete structure, each discrete structure incorporating a porous topmost section, said topmost section emplaced on top of sections of said barrier as a flowable mixture that hardens upon curing, said topmost section being of approximately the same composition as an underlayment immediately below said sections of barrier in each said discrete structure, comprising:

applying to the top surface of said underlayment of each said discrete structure at least one layer of adhesive material, said at least one layer of said adhesive material to include a topmost layer of said adhesive material, said applying done to said top surface of said underlayment of each said discrete structure prior to emplacing said topmost section for each said discrete structure;

placing said sections of barrier onto each said topmost layer of said adhesive material on each said discrete structure, said sections of barrier overlapping along edges of other said sections of barrier to establish a continuous array of said sections over each said discrete structure, each said section of barrier incorporating at least one layer of non-porous material, each said section of barrier having a total thickness less than about six mm, wherein each said array on each said discrete structure covers said topmost layer of said adhesive material on each said discrete structure;

sealing all said overlapped edges of said sections of barrier on each said discrete structure; and emplacing each said topmost section of each said discrete structure upon said array such that each said array is confined below said topmost section and above said topmost layer of said adhesive material for each said discrete structure.

2. The method of claim 1 providing said section of barrier as a first perforated plate abutted about its entire surface area to a second solid plate, each said first and second plates being of a total thickness of less than about 3 mm.

3. The method of claim 2 employing said first plate immediately adjacent the bottom side of said topmost section.

4. The method of claim 1 providing said section of barrier as at least one foil of a thickness less than about 1 mm.

5. The method of claim 4 said foil comprising a first perforated foil abutted about its entire surface area to a second solid foil, each said first and second foils being of a total thickness of less than about 2 mm.

6. The method of claim 5 employing said first perforated foil immediately adjacent the bottom side of said topmost section.

7. The method of claim 1 incorporating at least one expansion joint at edges of each said discrete structure that abut another said discrete structure, said expansion joint in operable communication with abutting sides of adjoining said discrete structures and abutting said underlayment, said adhesive, said section of barrier and said topmost section of each said discrete structure along said abutting edges of said adjoining discrete structures, said expansion joint further comprising a non-porous expandable strip that is placed under each said section of barrier at said abutting edges of said adjoining discrete structures to establish an overlap along the entire length of each side of said section of barrier along said abutting edges of each said discrete structure and below said section of barrier, each said overlap of a width less than about 5.0 cm, wherein said strip is sealed along each longitudinal edge of said strip between said strip and the bottom of each said section of barrier abutting said edges with a continuous bead of sealant along the entire length of said edges, said sealant remaining flexible upon cure.

* * * * *